United States Patent [19]

Loire

[11] 4,387,660

[45] Jun. 14, 1983

[54] SINGLE POINT MOORING

[75] Inventor: René Loire, San Francisco, Calif.

[73] Assignee: Morrison-Knudsen Company, Inc., Boise, Id.

[21] Appl. No.: 281,988

[22] Filed: Jul. 10, 1981

Related U.S. Application Data

[63] Continuation of Ser. No. 58,305, Jul. 17, 1979, abandoned.

[51] Int. Cl.[3] ..... B63B 21/00

[52] U.S. Cl. ..... 114/230; 114/256; 405/205; 405/207

[58] Field of Search ..... 114/230, 242, 256, 257; 141/279, 387, 388; 405/203, 205, 207, 209

[56] References Cited

U.S. PATENT DOCUMENTS

| | | | |
|---|---|---|---|
| 2,937,006 | 5/1960 | Thayer | 405/207 X |
| 3,022,633 | 2/1962 | Stimson | 405/207 X |
| 3,120,106 | 2/1964 | Foster | 114/230 X |
| 3,236,266 | 2/1966 | Bily | 141/1 |
| 3,388,556 | 6/1968 | Manning | 405/205 X |
| 3,522,787 | 8/1970 | Tam | 114/230 |
| 3,556,170 | 1/1971 | Bily | 114/230 X |
| 3,595,196 | 4/1968 | Riffeser | 114/230 |
| 3,668,875 | 6/1972 | Sander et al. | 114/230 X |
| 3,690,108 | 9/1972 | Tam | 114/230 X |
| 3,700,014 | 10/1972 | Scales et al. | 141/279 X |
| 3,774,253 | 11/1973 | Lecomte | 114/230 X |
| 3,859,804 | 1/1975 | Koehler et al. | 405/209 |
| 3,908,576 | 9/1975 | Van der Gaag | 114/230 |
| 3,964,423 | 6/1976 | Gassett et al. | 114/230 |
| 4,010,500 | 3/1977 | Reid, Jr. | 114/230 X |
| 4,042,990 | 8/1977 | Donaldson, Jr. | 9/8 P |
| 4,086,865 | 5/1978 | Statham | 114/230 |
| 4,127,004 | 11/1978 | Vilain | 405/205 X |

*Primary Examiner*—Sherman D. Basinger

*Attorney, Agent, or Firm*—Buell, Blenko, Ziesenheim & Beck

[57] ABSTRACT

The specification discloses a single point mooring for vessels comprising a base member adapted to rest on the ocean bottom, a cross member joined to the base member at one end thereof and a mooring post member joined to the base member at the opposite end and perpendicular to a plane intersecting the base member and cross member. Placing the single point mooring by floating, towing and sequential flooding is also disclosed.

9 Claims, 7 Drawing Figures

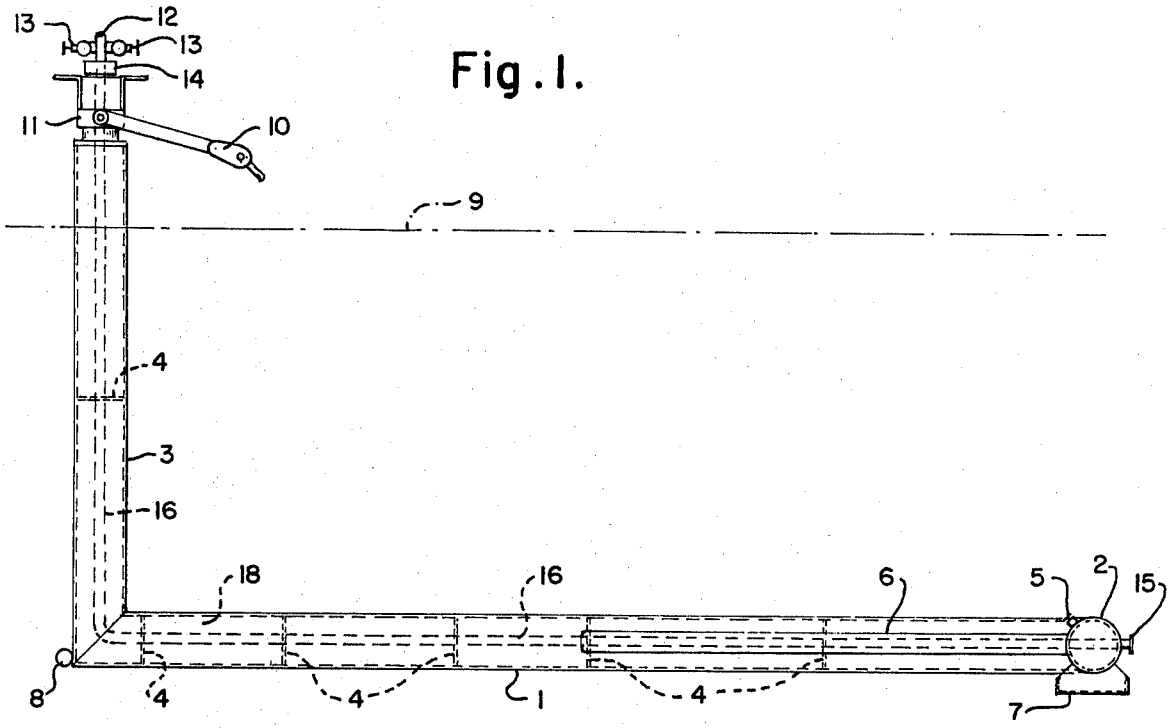
Fig. 1.
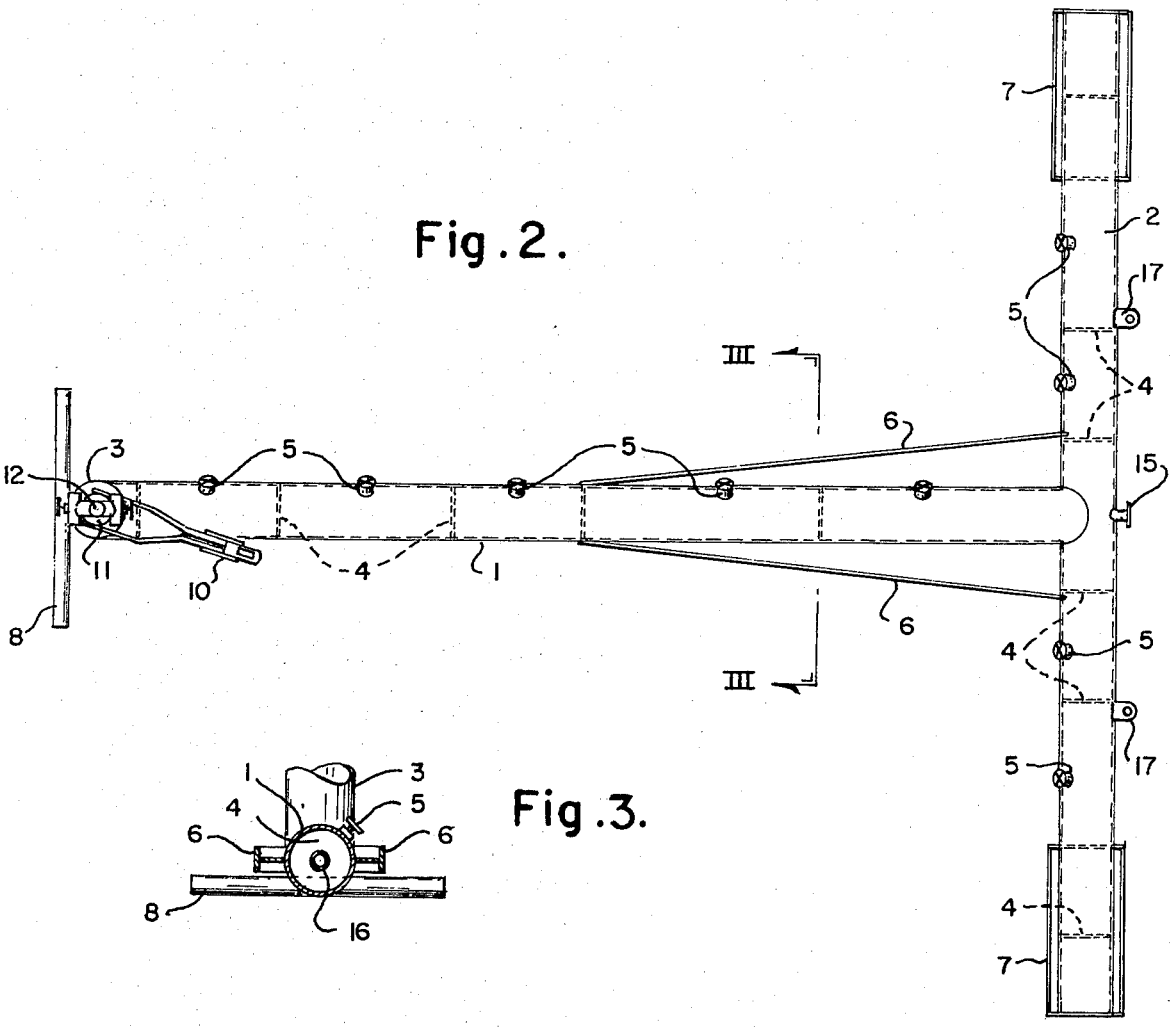
Fig. 2.
Fig. 3.

SINGLE POINT MOORING

This is a continuation of application Ser. No. 058,305, filed July 17, 1979, now abandoned .

This invention relates to single point mooring of vessels. More particularly it relates to apparatus and methods of mooring large ocean going vessels at a single point of attachment whereby the vessels are free to move about the mooring responsive to wind and current.

In the handling of cargo by ship it is a common practice to provide piers and docks to which the ships can be tied during cargo handling operation. In many cases, however, it is the practice to moor the ship in an offshore position. Such a practice is often followed where there is no suitable harbor which would permit feasible construction of a dock or pier. Even where harbors exist, the use of larger ships such as very large crude carriers ("VLCC") makes the harbors unusable for such larger ships. Where the product to be loaded or unloaded is a liquid and can be moved through a conduit the use of an offshore mooring is more feasible since lightering is unnecessary.

A wide variety of offshore mooring devices have been used or proposed. One such arrangement is a multi-buoy mooring in which a series of buoys are anchored about the area in which a ship is to be moored. The ship enters the area between the buoys and lines are then extended between the ship and the buoys. Each of the buoys may have several anchors with the result that a substantial amount of ground tackle is required. Moreover, the ship is not free to swing under the influence of wind and current with the result that some substantial forces may be generated on the ground tackle. If the product being handled is a liquid, such as a petroleum product, a sea line may be laid to the mooring area and one or more hoses provided for connection to the ship.

To avoid the problems resulting from wind or current acting on the side of a ship, a single point mooring may be used. One type of single point mooring is a single buoy mooring. The single buoy mooring is located over the end of the sea line. Six or eight anchors and associated chains are set out radially about the mooring buoy to hold it approximately over the end of the sea line regardless of the direction of pull by the ship moored to the buoy. A hose rises to the buoy and terminates in a swivel joint so that a further length of hose can be trailed from the buoy in any direction. The ship approaches the buoy and is moored at the bow to the buoy and the hose is then connected to the ship. The ship and hose are then free to swing in any direction under influence of wind and current. Both the anchor chains and the hoses of a single buoy mooring suffer from continuous friction and fatigue from movement of the buoy in the water. In many installations both the chains and the hoses must be replaced at intervals as frequent as every six months or every year. Failure to replace could lead to breakage of a chain or a hose with risk of grounding to the ship and a severe oil spill. Replacement can only be done in smooth weather with a risk that the mooring will be out of service while a ship is standing by for loading or discharge of cargo.

Both the mooring points and the connecting hose of a single buoy mooring must be arranged for rotation relative to the buoy. Because the buoy is a floating structure it cannot sustain any torsion, requiring that roller bearings be used for mounting to the buoy. Roller bearings, however, are subject to corrosion and are far less satisfactory in the ocean environment than ordinary friction bearings. Accordingly, there is a substantial cost associated with a single buoy mooring both in the expense of replacing weak components at periodic intervals and also the loss of ship capacity during the time the mooring is out of service.

Fixed mooring towers have also been used for single point mooring. In one form the tower is constructed of a series of piles driven into the ocean bottom and mounting a rotatable mooring head on ordinary friction bearings. Towers avoid the problems of wear and replacement of undersea components such as anchor chains and connecting hoses as well as roller bearings in the rotating head. The hose from mooring tower to ship must be replaced at periodic intervals, but that task can be done quite readily with minimum down time. Mooring towers have operated satisfactorily, but involve a substantial initial expense.

Another type of known mooring tower involves a large diameter single tube driven directly into the ocean floor. This arrangement is likewise satisfactory for performance but involves a substantial expense including making available a pile driver which can handle a large diameter heavy wall tubing.

Mooring towers also possess several other advantages over buoy type mooring. If a variety of products are to be run through the sea line the platform on a mooring tower makes it easy to pass a pig through the line for cleaning purposes. It has been found that the mooring pull in a bow hawser is lower with a fixed mooring tower than with a buoy. The apparent reason is that surges may cause the ship and the buoy to be moving in opposite direction developing a tension peak in a bow hawser.

To avoid the problems of construction and expense attendant upon fixed mooring towers it has been proposed to construct a ready made dolphin by fabricating a series of beams into a rectangular grid-like structure. A tube is mounted to the grid-like structure perpendicular to the plane of the grid. The opposite end of the tube carries a rotating head for the mooring line and a swivel joint for the oil line. Such a structure may be fabricated at a point remote from the mooring site and then towed to the site. The beams forming the grid are hollow and may be made buoyant by filling them with air so that the structure floats upon arrival at the site, the beams at the rear of the structure are flooded to cause the rear of the grid to sink toward the bottom. After landing the rear edge, the beams at the front edge of the grid are also flooded to fully land the grid on the bottom with the single tube projecting upwardly. A problem with such a structure is that it is unstable in towing and may yaw when in tow. Because of the instability it is difficult to land at precisely the location desired. Also a retangular grid is of very substantial weight. Much of the weight of the grid is inactive and of minimal benefit for a pull in any given direction upon the mooring.

I provide a single point mooring comprising a first structural member, a second structural member unitary with the first structural member and perpendicular thereto, and a third structural member unitary with the second structural member at a point remote from the first structural member. I prefer to dispose the third member substantially perpendicular to a plane formed by the first two members. I make the members hollow and air-tight and provide flooding ports whereby the structure may be air-filled for buoyancy or water-filled to land it on the bottom. I prefer to provide flukes upon one of the structural members for engagement with the bottom and to oppose dragging under pull from a moored vessel.

In a preferred form of the invention I provide two structural members in the form of a T. I provide a base member and a cross bar member whose mid-point is joined to one end of the base member. I further provide a mooring post member, or dolphin, one end of which is joined to the second end of the base member with the mooring post member being perpendicular to a plane intersecting the base member and the cross bar member. I prefer to mount a mooring head and hose swivel on the end of the mooring post member opposite to the base member. I prefer to make the base member, cross-bar member and mooring post member hollow and to divide them into separate water tight compartments. I further prefer to provide valve means for each compartment whereby each compartment may be separately flooded or drained of water. I further prefer to provide a sea line connection at the cross bar member and to provide a conduit internal of the cross bar member, the base member, and the mooring post member and extending from the sea line connection at the cross bar member to a hose swivel at the free end of the mooring post member.

I prefer to fabricate the mooring structure at a convenient point which may be distant from the installation site. The structure is then towed by tug to the installation site. The junction of the base member and mooring post member may be submerged a desired distance by selective flooding of the base member and mooring post member. The submerged portion of the base member and mooring post member extend in the direction of towing and thereby serve as a keel to simplify towing to the site. When the structure is close to the desired site the structure may be further flooded until the junction of the base member and mooring post member is lightly dragging on the bottom. Further towing will tend to align the structure with the sea line. The alignment can be followed until the exact site is reached. At that point further flooding will accurately position the structure on the bottom and towing ceases.

Other details, objects and advantages of the invention will become more apparent as the following description of the present preferred embodiment thereof proceeds.

In the accompanying drawings I have illustrated a present preferred embodiment of my invention in which:

FIG. 1 is a side elevational view of a single point mooring embodying the invention;

FIG. 2 is a plan view of the single point mooring shown in FIG. 1;

FIG. 3 is a sectional view taken along line III—III of FIG. 2;

Figure 4:
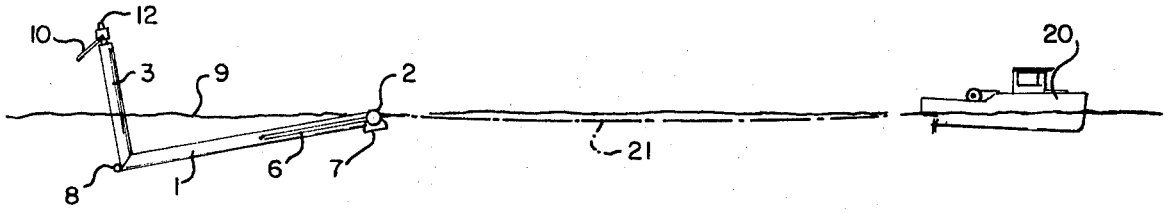
FIG. 4 is a side elevational view diagrammatically showing the single point mooring under tow to the installation site.

The single point mooring structure comprises a base member 1, a cross member 2, and a mooring post member 3. The mid point of cross member 2 is joined at one end of the base member 1. Mooring post member 3 is connected to the opposite end of base member 1 perpendicular to the plane which intersects base member 1 and cross member 2. Each of the three main structural members is formed of hollow tubular material. Bulkheads 4 are placed internally of base member 1, cross member 2, and mooring post member 3 to divide them internally into separate water tight compartments. Each of the compartments formed by bulkheads 4 is equipped with a valve 5 through which water may be admitted to the compartment to flood it and through which air may be pumped to drive water from the compartment. A second valve or an opening may be provided in the bottom of each compartment to facilitate flooding and blowing operations. A gusset 6 is provided on each side of base member 1 adjacent the junction with cross member 2 to reinforce the joint between them. A fluke 7 is mounted on the lower side of cross member 2 at each end of the cross member. A stabilizer 8 is mounted at the opposite end of base member 1 parallel to cross member 2.

When the mooring structure is suitably landed on the bottom, the free end of mooring post 3 will project above the water 9 (FIG. 1). A mooring shackle 10 is mounted on a bearing ring 11 for rotation about the axis of mooring post 3. A liquid product manifold 12 includes valves 13 through which liquid product can be received from or discharged to a vessel. Manifold 12 is mounted on a swivel 14 for rotation about the axis of mooring post 3. If desired fittings may be provided to accomodate pitch and roll of the ship. A fitting 15 is located on cross member 2. A pipe 16 extends from fitting 15 to swivel 14 and enables liquid product to be transferred between manifold 12 and fitting 15. Pipe 16 is positioned internally of base member 1, cross member 2, and mooring post member 3 to protect it from damage.

Two towing eyes 17 are fitted to cross member 2 on opposite sides of the axis of base member 1.

Figure 5:
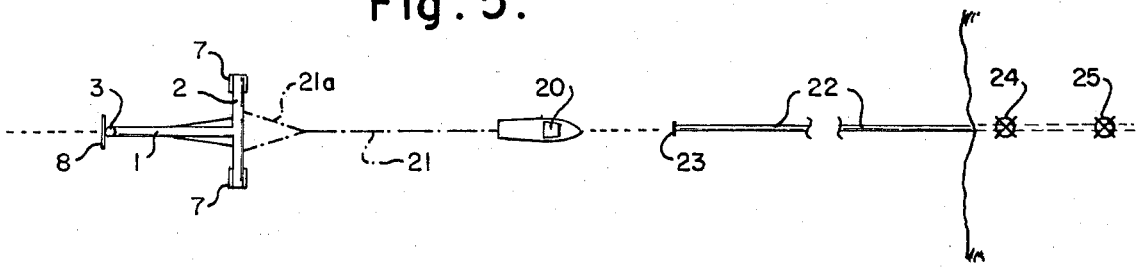
FIG. 5 is a plan view diagrammatically showing the tow approaching the installation site.

If the mooring is to be used with a large tanker of perhaps 250,000 dead weight tons the length of base member 1 and cross member 2 may each be in the order of 60 meters (or about 200 feet) and the vertical height of mooring post 3 may be in the order of 30 meters (or about 100 feet). The location of suitable fabrication facilities may make it necessary or desirable, however, to fabricate the single point mooring at a location which is hundreds or even thousands of miles away from the point of use. Accordingly, a long ocean tow may be required to transport the mooring structure from the place of fabrication to the place of use. For purposes of towing the water tight compartments between bulkheads 4 are blown dry and valves 5 are closed. The structure will then be buoyant and will float on the surface of the water. One or more of the compartments between bulkheads 4 adjacent the junction of base member 1 and mooring post member 3, such as compartment 18, are flooded to reduce buoyancy at the point of junction. The mooring structure is then taken in tow for a voyage to the point of use. A tug 20 is connected by a tow line 21 to a towing bridle **21*a* (FIG. 5) connected to towing eyes 17. The reduced buoyancy adjacent the junction of base member 1 and mooring post member 3 causes the point of junction to be submerged beneath the surface of the water 9 (FIG. 4). As towing proceeds base member 1** effectively acts as a keel and keeps the structure on a substantially straight line without yawing and without oscillating from side to side across the wake of the tug.

Figure 6:
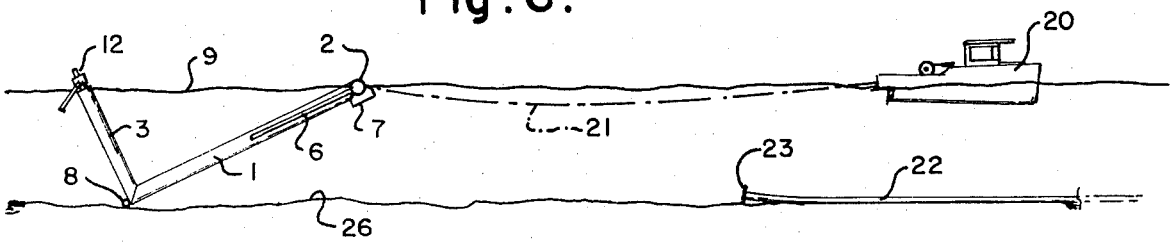
FIG. 6 is a side elevational view diagrammatically showing initial landing of the single point mooring on the ocean bottom as it approaches the installation site.
Figure 7:
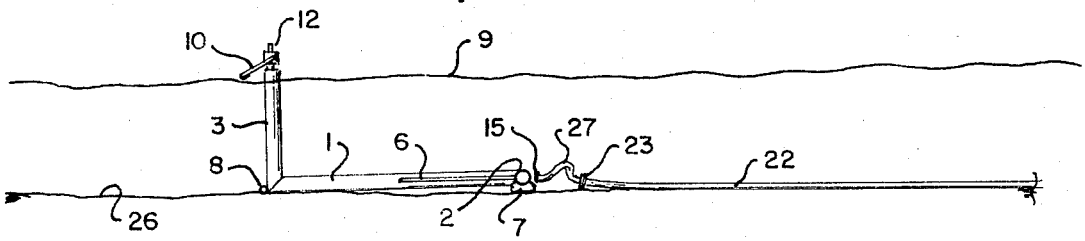
FIG. 7 is a side elevational view in final position and connected to the sea line.

A sea line 22 laid off shore on the bottom of the ocean terminates in a fitting 23. The shore end of sea line 22 may lead to a tank farm. Range markers 24 and 25 are located on shore aligned on the axis of sea line 22. Tug 20 sights on range markers 24 and 25 and approaches the shore on alignment with sea line 22. If cross currents or winds are encountered, a second tug may tie onto the mooring structure to offset the effect of wind and current and to keep it on a direct line behind tug 20 and along a projection of the axis of sea line 22. Where necessary the tug may approach the installation point on another axis which substantially intersects the end of the sea line. As the point of installation is approached, valves 5 are selectively opended to cause additional flooding at the end where mooring post 3 is positioned. The compartments are flooded sufficiently to create a slight negative buoyancy so that the junction of base 1 and mooring post 3 sinks to the bottom of the harbor 26 (FIG. 6). Stabilizer bar 8 serves to level the structure and return mooring post member 3 to a substantially vertical direction in case it should become tilted to one side during settling to the bottom. The opposite end of base member 1 at cross member 2 is still buoyant, however, since the compartments in that area have not yet been flooded. Accordingly, that end of the structure will still be floating as shown in FIG. 6. Towing continues at slow speed until fitting 15 on cross member 2 comes close to fitting 23 on sea line 22. All compartments are then flooded to sink the structure to the bottom. Sea line 22 is then connected to the mooring structure by a flexible hose 27 extending between fittings 15 and 23. The towing line is disconnected and the single point mooring is ready for service.

A ship may then tie on to the mooring shackle 10 with a bow hawser and connect hoses between the ship and manifold 12. The ship is free to swing around mooring post member 3 on any alignment responsive to wind and current. Since the ship is free to swing it exerts a minimum pull on the mooring. Under load from a moored vessel flukes 7 will tend to dig into the harbor bottom 26 and resist sliding along the bottom.

A pull on mooring shackle 20 tends to exert an overturning force which is resisted by the weight of structure. A substantial part of the weight will be of maximum effectiveness in resisting an overturning force. If, for example, the moored vessel settles into a position above the sea line the pull of the vessel will attempt to rotate the structure about a pivot axial with cross member 2. The pull will be resisted by the weight of base member 1 and mooring post member 3. The length of base member 1 will provide a substantial moment arm for the weight of base member 1 and mooring post member 3. Cross member 2 will be substantially inactive under that condition. If the pull of the moored ship is in the opposite direction from the sea line the pull will attempt to rotate the structure on a pivotal axis at the junction of base member 1 and mooring post member 3. The weight of base member 1 and cross member 2 will resist the overturning force. Again the length of base member 2 will provide a substantial moment arm for the weight of base member 1 and cross member 2. Mooring post member 3 will be substantially inactive. If the pull of the vessel is on a line perpendicular to the axis of the sea line, the pivotal axis will be on a line between the near end of stabilizer bar 8 and the near end of cross member 2. All of the weight will resist the overturning force, and most of the weight will be effective over a substantial moment arm.

While I have illustrated and described a present preferred embodiment of my invention and a method of using the same it is to be understood that I do not limit myself thereto and that the invention may be otherwise variously practiced within the scope of the following claims.

I claim:

1. A single point mooring comprising a tubular base member which rests on the ocean bottom along its length and consists essentially of a plurality of floodable compartments, a tubular cross member rigidly joined to one end of the base member in the plane of the base member at a point intermediate the ends of the cross member and consisting essentially of a plurality of separately floodable compartments, and which rests on the ocean bottom along its length, and a mooring post member rigidly joined to the end of the base member remote from the cross member and projecting upward perpendicular to a plane intersecting the base member and cross member.

2. A single point mooring as set forth in claim 1 in which valve means are associated with said floodable compartments for selectively flooding and blowing said compartments.

3. A single point mooring as set forth in claim 2 enclosing a liquid product line extending between the upper end of the mooring post member and a point in proximity to the ocean bottom.

4. A single point mooring as set forth in claim 3 having flukes positioned to engage the ocean bottom and resist dragging by a moored ship.

5. A single point mooring including a major framework which consists essentially of a base member which rests on the bottom of the ocean along its length, a cross member which rests on the bottom of the ocean along its length and is rigidly joined to the base member with the axis of the cross member intersecting the axis of the base member, and a mooring post member whose axis is perpendicular to a plane intersecting the base member and cross member which is rigidly joined to the base member and cross member and which projects vertically upward from the plane of the base member and cross member said base member and cross member consisting essentially of tubular members divided into a plurality of selectively floodable compartments.

6. A single point mooring as set forth in claim 5 in which the base member, cross member, and mooring post member are provided with a plurality of watertight compartments and valve means for selectively flooding said compartments.

7. A single point mooring as set forth in claim 6 having a liquid product line extending from the upwardly projecting end of the mooring post member to a fitting at one end of the base member and cross member.

8. The method of positioning a single point mooring structure including an elongated keel-like member having two ends which comprises floating the structure, adjusting the bouyancy of the structure to sink the elongated keel-member into the water, towing the structure to a point short of the point of use, ballasting the structure to cause the rear end of the keel-like member to touch lightly on the bottom of the ocean while maintaining the forward end of the keel-like member clear of the bottom, continuing to tow the structure to the point of use, and then ballasting the structure further such that both ends of the keel-like member rest on the bottom.

9. The method of establishing a single point mooring suitable for large ocean going vessels which comprises forming a floatable framework which includes an elongated member intended to rest on the bottom of the ocean at an installation site, floating the framework and adjusting its buoyancy to sink the elongated member into the water whereby the elongated member will act as a keel when the structure is under tow, towing the framework in the direction of the axis of the elongated member to a point short of the installation site, ballasting the framework to cause one end of the elongated member to touch lightly on the bottom of the ocean while maintaining the other end of the elongated member clear of the bottom, continuing to tow the framework to the installation site with the end of the elongated member which is touching the bottom trailing the other end of the elongated member until reaching the installation site and then ballasting the framework further such that both ends of the elongated member rest on the bottom.

* * * * *

UNITED STATES PATENT AND TRADEMARK OFFICE

CERTIFICATE OF CORRECTION

PATENT NO. : 4,387,660

DATED : June 14, 1983

INVENTOR(S) : Rene Loire

It is certified that error appears in the above-identified patent and that said Letters Patent is hereby corrected as shown below:

Column 5, line 16, "opended" should be --opened--.

Column 5, line 44, "shackle 20" should be --shackle 10--.

Signed and Sealed this

*Twenty-third* Day of *August 1983*

[SEAL]

*Attest:*

GERALD J. MOSSINGHOFF

*Attesting Officer*

*Commissioner of Patents and Trademarks*